US005151403A

United States Patent [19]

Suzuki et al.

[11] Patent Number: 5,151,403

[45] Date of Patent: Sep. 29, 1992

[54] THERMAL PRINTING MEDIUM, AND LABEL AND TAG INCORPORATING THE SAME

[75] Inventors: Akira Suzuki; Takayuki Norizuki; Yasuhiro Yamanashi, all of Shizuoka, Japan

[73] Assignee: Tomoegawa Paper Co., Ltd., Tokyo, Japan

[21] Appl. No.: 655,860

[22] Filed: Feb. 15, 1991

[30] Foreign Application Priority Data

Feb. 16, 1990 [JP] Japan ..... 2-13692[U]
Feb. 16, 1990 [JP] Japan ..... 2-33801

[51] Int. Cl.[5] ..... B41M 5/30; B41M 5/36; B41M 5/40

[52] U.S. Cl. ..... 503/200; 427/152; 503/226

[58] Field of Search ..... 427/152; 503/200, 226

[56] References Cited

U.S. PATENT DOCUMENTS 4,370,370 1/1983 Iwata et al. ..... 428/913
4,717,709 1/1988 Suzuki ..... 503/200
4,727,055 2/1988 Aoyagi et al. ..... 503/200

FOREIGN PATENT DOCUMENTS 63-299976 12/1988 Japan ..... 503/200
2192288 1/1988 United Kingdom ..... 503/200

*Primary Examiner*—Pamela R. Schwartz
*Attorney, Agent, or Firm*—Finnegan, Henderson, Farabow, Garrett & Dunner

[57] ABSTRACT

A thermal printing medium having high mechanical strength, and a label and tag incorporating such a thermal printing medium is disclosed. In additional to high mechanical strength, the thermal printing medium of the present invention provides for excellent printing density and reslution, for which reason the medium is very applicable to bar codes and the like. The thermal printing medium which includes a multilayer structure consisting of a support substrate comprised of polyolefin type cross-laminate film; a thermal developing layer over the above mentioned under layer, comprised chiefly of colorless or lightly colored leuco-type dye and color developer agent; and a protective layer over the above mentioned thermal developing layer.

11 Claims, 2 Drawing Sheets

THERMAL PRINTING MEDIUM, AND LABEL AND TAG INCORPORATING THE SAME

BACKGROUND OF THE INVENTION

1. Field of the Invention

The present invention pertains to thermal printing media, and in particular, to thermal printing media having high mechanical strength.

2. Prior Art

Thermal printing media incorporating a heat sensitive substrate layer comprised chiefly of colorless or light colored thermally reactive leuco-type dyes and used for the recording of text and other types of visual information are conventionally known, for example, the material disclosed in Japanese Patent Application, First Publication Serial No. Sho-45-14035. Letters, numbers, patterns and the like can be recorded on this type of material by means of a thermal printer, using the thermal printing head therein for transfer of the image to the printing medium. This type of printing medium, therefore, offers a great number of advantages which are inherent to thermal printing methods. Namely, thermal printers tend to be relatively inexpensive and of compact design, operate cleanly and quietly, seldom require maintenance, and produce exceedingly legible printed images at a high output rate. Thermal printers are also widely available and are used for a great variety of printing applications including computer hard copy, cash registers and printing calculators, facsimile devices, and for many other devices which produce printed output. Additionally, use of thermally developing printing media eliminates the need for additional fixing or developing processes.

One application for which the above described type of heat sensitive media has enjoyed rapidly expanding popularity in recent years is for labels or tags. For example, such tags indicate the destination of the traveler to whom the luggage belongs and are attached to stowed luggage in commercial aircraft. These tags may be exposed to extreme temperature conditions in the luggage compartment of an aircraft in flight, and furthermore, are subject considerable physical abuse in the course of baggage handling and transport. Thus, these tags must be able to withstand considerable shearing forces, as well as abrasion to surfaces thereof if they are to survive intact with the printed information clearly legible so as to serve their ultimate purpose of indicating the destination of the luggage.

One method which has been conventionally applied in order to improve the durability of such luggage tags is to apply a thermal printing paper having a protective layer over a synthetic resin film, thereby enhancing the mechanical strength thereof. Application of the synthetic resin film, however, necessitates additional steps in the manufacture of the labels and tags, thereby increasing their cost. Furthermore, with application of heat during printing, adhesives used to attach the synthetic resin film to the thermal printing paper tend to fog the thermal paper and may exude from the sides of the labels and tags, leading to maintenance problems if the exuded adhesive accumulates on the thermal printing head or other components of the printer.

Additionally, paper supported thermal printing media have certain limitations in the achievable resolution. For this reason, such media may be unsuitable for printing of high precision bar codes which been implemented in recent years.

SUMMARY OF THE INVENTION

In view of the above described limitations of conventional thermal printing media, it is an object of the present invention to provide a thermal printing media having improved mechanical properties including resistance to tearing, and on which printing can be accomplished at high resolution.

In order to achieve the above described object, the present invention provides a thermal printing medium which includes a multilayer structure consisting of a support substrate comprised of polyolefin type cross-laminate film; a thermal developing layer over the above mentioned support substrate, comprised chiefly of colorless or lightly colored leuco-type dye and color developer agent; and a protective layer over the above mentioned thermal developing layer. The present invention also provides a thermal printing medium having the multilayer structure described above, further including an under layer between the above mentioned support substrate and the thermal developing layer, consisting essentially of hydrophobic polymer.

By using polyolefin type cross-laminate film for the above described support substrate, the thermal printing medium of the present invention is exceedingly resistant to tearing forces from any direction, even under exceedingly severe conditions where very large tensile forces are applied at points near a peripheral edge of a sheet of this thermal printing medium. Moreover, in addition to the excellent mechanical properties, excellent printing density and resolution can be achieved with the printing medium of the present invention, for which reason this medium is very applicable to micro bar codes and the like.

It is also an object of the present invention to provide a highly durable thermal printing medium which can be used as a label and tag. So as to achieve this object, the present invention provides a thermal printing medium which includes a multilayer structure consisting of a support substrate comprised of polyolefin type cross-laminate film; a thermal developing layer over the above mentioned support substrate, comprised chiefly of colorless or lightly colored leuco-type dye and color developer agent; a protective layer over the above mentioned thermal developing layer; and a peelable sheet applied via an adhesive agent over the side of the above mentioned support substrate opposite to the side adjacent to the under layer.

The present invention also provides a label and tag having the multilayer structure described above, further including an under layer comprised chiefly of hydrophobic polymer between the above mentioned support substrate and thermal developing layer.

By using polyolefin type cross-laminate film for the above described support substrate, the thermal printing medium of the present invention is exceedingly resistant to tearing forces from any direction.

DETAILED DESCRIPTION OF THE PREFERRED EMBODIMENTS

Figure 1:
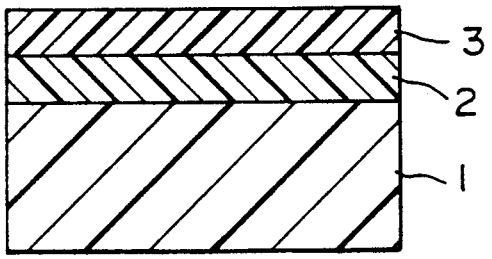
FIG. 1 is a cross-sectional schematic drawing illustrating the multilayered structure of a thermal printing medium in accordance with the present invention.

The present invention is characterized in that a cross-laminated film is used for the support substrate, as is shown in FIG. 1. In the following, the component elements of the thermal printing media of the present invention will be described in detail.

The support substrate used in the thermal printing media of the present invention is a polyolefin type cross-laminate film, manufactured by a process in which two sheets of polyolefin film are laminated together using polyolefin adhesive therebetween, thereby forming an intermediate polyolefin resin layer between the two sheets. The above mentioned sheets of polyolefin film develop a microstructure during manufacture thereof in which polymer macromolecules assume a linear, parallel aligned configuration, which forms an angle of 45° with the longitudinal axis of the sheets. During the lamination process, the two sheets of polyolefin film are positioned with respect to one another at an angle of 90°, whereby the angle defined by the orientation of the linear macromolecules in one sheet also come to form an angle of 90° with respect to those of the other such that maximal resistance to tearing is provided. Such a cross-laminate film is characterized by having considerable mechanical strength, while at the same time maintaining pliability. In this support substrate, improved mechanical strength is provided by setting the angle defined between the two sheets to equal 90°. As employed in the present invention, the optimal thickness of the polyolefin type cross-laminate film is on the order of 50–100 μm. Even though this is relatively thin, an acceptable degree of mechanical strength is proved by the cross-laminate structure. Additionally, it is desirable to treat the surfaces of the support substrate using corona electrical discharge processing so as to impart adhesion characteristics to the polyolefin.

Figure 2:
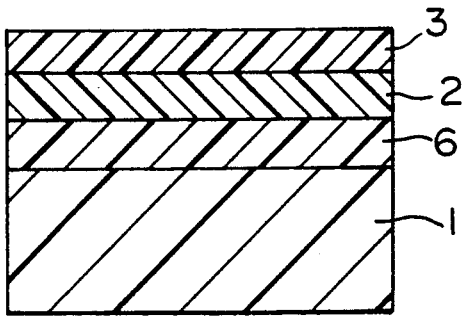
FIG. 2 is a cross-sectional schematic drawing illustrating the multilayered structure of another thermal printing medium in accordance with the present invention.

The thermal printing medium of the present invention shown in FIG. 2 differs from that of FIG. 1 in that an under layer 6 is included. The under layer 6 applied over the above described support substrate acts to improve adherence between the support substrate and the thermal developing layer, and to enhance the thermal sensitivity of the thermal developing layer. As has been mentioned previously, the chief constituent of this layer is hydrophobic polymer. It is believed that the mechanism through which the under layer works to enhance the thermal sensitivity of the thermal developing layer involves an insulating function, whereby the under layer prevents transmission of thermal energy from the thermal developing layer to the support substrate and diffusion therein. To the extent that the Tg (glass transition temperature) of the under layer is low, improvement in insulating properties thereof and increased resolution during printing is achieved. Accordingly, for the under layer employed in the present invention, a hydrophobic polymer should be used having a Tg of 50° C. or less, and more preferably, of 30° C. or less.

Suitable examples of hydrophobic polymer applicable to the under layer in the present invention include at least one type of polymer selected from the group including SBR (styrene-butadiene rubber), styrene acrylic ester copolymer and styrene methacrylic ester copolymer. For these polymers, polymers which are soluble in organic solvents can be used, however, any organic solvent which remains in these polymers following manufacture thereof can lead to fogging and loss of resolution in the thermal developing layer. For this reason, aqueous latex or aqueous emulsion type polymers are generally more desirable.

With the under layer employed in the present invention, pigments may be added as necessary. Organic or inorganic pigments may be used as desired, for example, light calcium carbonate, heavy calcium carbonate, aluminum hydroxide, titanium oxide, zinc oxide, barium sulfate, talc, clay, satin white, kaolinite, polyolefin particles, polystyrene particles, urea-formalin resin particles and the like. In order to provide optimal printing characteristics, the ratio by weight of hydrophobic polymer to pigment should be in the range of from 10:0 to 1:9, and preferably in the range of from 10:0 to 3:7. Additionally, the thickness of the under layer should be 1 μm or greater, or more preferably, 3 μm or greater so as to provide optimal printing characteristics.

In the thermal developing layer of the thermal printing medium of the present invention, colorless or lightly colored leuco-type dye and color developer agent are incorporated as principal constituents thereof. Representative examples of leuco-type dyes include, but are not limited to, crystal violet lactone, 3-diethylamino-7-chlorofluoran, 3-diethylamino-6-methyl-7-chlorofluoran, 3-cyclohexylamino-6-chlorofluoran, 3-diethylamino-7-dibenzylaminofluoran, 3-pyrrolidino-6-methyl-7-anilinofluoran, 3-piperidino-6-methyl-7-anilinofluoran, 3-cyclohexylmethylamino-6-methyl-7-anilinofluoran, 3-ethylisoamylamino-6-methyl-7-anilinofluoran, 3-diethylamino-7-(o-chloroanilino)fluoran and 3-dibutylamino-7-(o-chloroanilino)fluoran.

Representative examples of color developer agents which are used in the thermal developing layer include, but are not limited to, α-naphthol, β-naphthol, 4-t-butylphenol, 4-t-octylphenol, 4-phenylphenol, 2,2-bis(p-hydroxyphenyl)propane, 2,2-bis(p-hydroxyphenyl)butane, 4,4'-cyclohexylidine diphenol, 2,2-bis(2,5-dibromo-4-hydroxyphenyl)propane, 4,4'-isopropylidine bis(2-t-butylphenol), 2,2'-methylene bis(4-chlorophenol), 4,4'-sulfonyldiphenol, 4,4'-thiobisphenol, as well as derivatives of benzoic acid, salicylic acid and gallic acid.

To improve the thermal sensitivity of the thermal developing layer, various types of substances having a low melting point can be added. Applicable examples of low melting point additives include organic compounds having a suitably low melting point, such as stearic amide and other amides of higher fatty acids, naturally occurring waxes such as beeswax, shellac wax and carnauba wax, mineral waxes such as montan wax, paraffin wax, microcrystalline wax, higher fatty acids, esters of higher fatty acids, esters of aromatic carboxylic acids such as dimethylterephthalate and diphenylphthalate, derivatives of alkyl naphthalene compounds, derivatives of alkyl diphenyl compounds, derivatives of alkyl terphenyl compounds, among others.

In the course of manufacturing the thermal printing medium of the present invention, a dispersion used to form the thermal developing layer containing the above described leuco type dye, color developer agent, and optionally, low melting point additive is prepared by pulverizing the component elements together in a wet type media dispersion apparatus, controlling conditions such that the resulting particle size of each component is no greater than 5 μm, and more preferably, no greater than 3 μm.

In the preparation of the above described dispersion, as a filler agent, organic or inorganic pigments may be optionally added so as to improve the resolution of developed images with the thermal printing medium of the present invention. Examples of such filling agents include light calcium carbonate, heavy calcium carbonate, aluminum hydroxide, titanium oxide, zinc oxide, barium sulfate, talc, clay, satin white, kaolinite, polyolefin particles, polystyrene particles, urea-formalin resin particles and the like.

In addition to the various above described required substances and optional additives for the thermal developing layer, other optional ingredients which may be added as necessary include surfactants, anti-foaming agents, anti-oxidants, ultraviolet light absorbing agents, and the like. All of the constituents making up the thermal devoloping layer are held together using a binder agent. Examples of suitable binding agents include casein, gelatin, polyvinyl alcohol, polyvinyl pyrrolidone, starch, converted starch, isobutylene - maleic anhydride resin, diisobutylene - maleic anhydride resin, styrene - maleic anhydride resin, polyacrylamide, converted polyacrylamide, carboxymethylcellulose, methylcellulose, hydroxyethylcellulose, polyvinyl acetate, acrylic ester polymer, vinyl chloride - vinyl acetate copolymer, emulsions such as SBR (styrene-butadiene rubber) and NBR (nitrilebutadiene rubber), latex, as well as mixtures of any of the preceding.

The externalmost protective layer of the thermal printing medium of the present invention provides resistance to tearing, abrasion, and development of artifactual markings resulting from externally applied pressure or penetration of chemical agents. For this reason, the essential constituent of the protective layer is a polymer binding agent having excellent layer forming characteristics. For this polymer binding agent, any of the various water soluble and water insoluble resin binding agents employed in the thermal developing layer may be used, however, for imparting impermeability to plasticizers, oils and other oleophilic chemical agents, the water soluble type binding resins are most suitable. Because the water resistance characteristics of such water soluble type binding resins tend to be poor, it is desirable to also include a component imparting water resistance. Examples of additives which may be used to improve water resistance include mixtures such as emulsions and latex, glyoxal, chrome alum, melamine resin, melamine formaldehyde resin, polyamide resin, polyamide epichorohydrin resin, and others.

In addition to one or more of the above described polymer binding agents, the protective layer may also include various additives as desired to enhance characteristics at the interface between the thermal printing head and the printing medium. Examples of such additives include organic and inorganic pigments, agents such as zinc stearate and calcium stearate which impart a smoother surface to the protective layer so that the thermal printing head may slide thereover more easily, and surface lubricants such as fluorocarbon resins.

To manufacture the thermal printing media of the present invention, each of the above described under layer, thermal developing layer, and protective layer are each successively applied then dried in that order over the support substrate. Any of numerous well known methods for painting or otherwise applying a layer over a surface can be employed. Examples of such methods include air knife coating, roller coating, bar coating, blade coating, as well as other methods. As suits the manufacturing situation, a back layer can be applied to the surface of the support substrate opposite the under layer, so as to impart resistance to curling and other problems. Additionally, when desirable, a peelable sheet can be applied to the opposite surface of the support substrate through application of an adhesive layer and silicon treated paper. For the above mentioned adhesive layer, various well known pressure sensitive adhesives can be employed, such as polyacrylate ester adhesive agents and the like.

Figure 3:
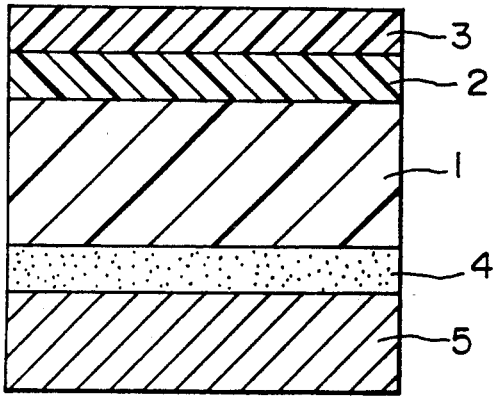
FIG. 3 is a cross-sectional schematic drawing illustrating the multilayered structure of a thermal printing medium in accordance with the present invention.

In the case of the thermal printing medium having the structure shown in FIG. 3, directly over the polyolefin type cross-laminate film support substrate 1, a thermal developing layer 2 comprised chiefly of colorless or lightly colored leuco-type dye and color developer agent is applied, over which is then applied a protective layer 3. To the surface of the support substrate 1 opposite that to which the thermal developing layer 2 is applied, a peelable backing sheet 5 is attached using an intervening adhesive layer 4. For the above mentioned support substrate 1, thermal developing layer 2, and protective layer 3, their counterparts as described in the preceding description of the thermal printing medium of the present invention can be employed. In the case of the thermal printing medium having the structure shown in FIG. 4, an under layer 6 consisting essentially of hydrophobic polymer is included, intervening between the support substrate 1 and thermal developing layer 2.

Figure 4:
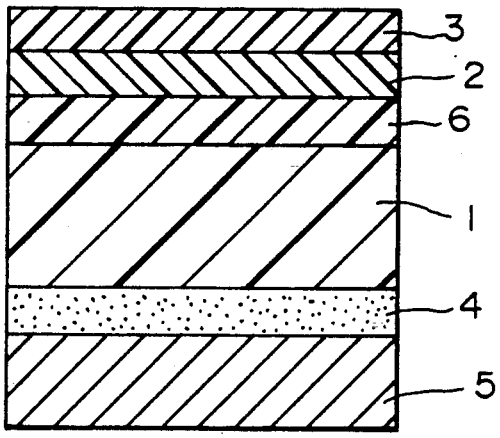
FIG. 4 is a cross-sectional schematic drawing illustrating the multilayered structure of another thermal printing medium in accordance with the present invention.
Figure 5:
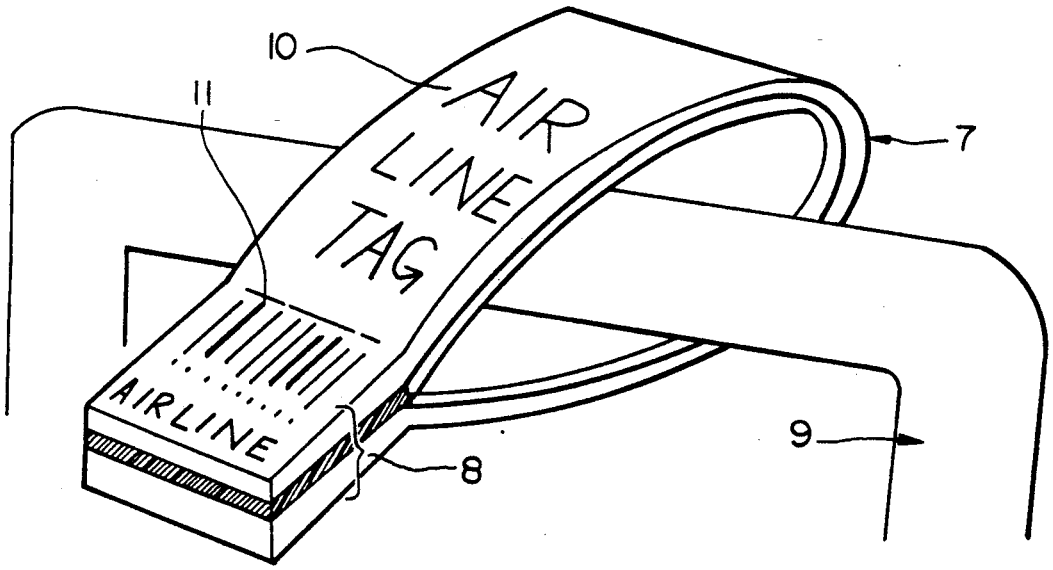
FIG. 5 is a drawing illustrating a label and tag in accordance with the present invention in actual use, applied as an airline luggage tag.

In FIG. 5, a tag 7 in actual use is shown, wherein thermal printing medium having the structure shown in FIGS. 3 or 4 can be suitably employed. As can be seen in FIG. 3, this tag 7 includes a thermally printed identifying label 10 and bar code 11. In this case, the peelable backing sheet was removed from both ends of the tag 7, thereby exposing the underlying adhesive layer 4 at each end of the back surface of the tag 7, after which the tag was wrapped around the handle 9 of a suitcase or the like and the exposed adhesive layers at each end were then pressed together to form a strongly adherent cojoined portion 8, thereby reliably attaching the tag 7 to the luggage.

EXAMPLES

In the following, the manufacture and characteristics of actual examples of the thermal printing medium of the present invention will be described and compared with comparative examples.

EXAMPLE 1

A corona electrical discharge processed 75 μm thick polyolefin type cross-laminate film (KM Film 750 W; Sunrex manufacturing, Inc.) was used for the support substrate.

Next, as component dispersions used together to prepare the thermal developing layer, dispersions having the composition of dispersions A, B and C below were prepared using a sand mill.

| | |
|---|---|
| dispersion A: | |
| 3-dibutylamino-7-(o-chloroanilino)fluoran | 30 parts |
| 5% methylcellulose aqueous solution | 50 parts |
| water | 20 parts |
| dispersion B: | |
| 4,4'-thiobis(2-methylphenol) | 30 parts |
| 5% polyvinyl alcohol aqueous solution | 50 parts |
| water | 20 parts |
| dispersion C: | |
| kaolin | 40 parts |
| 5% polyvinyl alcohol aqueous solution | 40 parts |
| water | 20 parts |

A composite dispersion was then prepared by mixing each of dispersions A, B and C, together with aqueous polyvinyl alcohol solution in the following proportions:

| | |
|---|---|
| dispersion A | 30 parts |
| dispersion B | 90 parts |
| dispersion C | 100 parts |
| 10% polyvinyl alcohol aqueous solution | 150 parts |

Thus prepared, the composite dispersion was then applied over the previously prepared support substrate and dried to form a thermal developing layer, such that the dry weight thereof was 7 g/m$^2$. A protective layer material was then prepared having the composition listed below:

| | |
|---|---|
| 10% polyvinyl alcohol aqueous solution | 100 parts |
| dispersion C | 20 parts |
| 10% zinc stearate aqueous dispersion | 5 parts |

Thus prepared, the protective layer material was then applied over the previously prepared thermal developing layer and dried to from a protective layer, such that the dry weight thereof was 4 g/m$^2$.

To the exposed surface of the support substrate of the printing media thus manufactured, polyacrylate ester type emulsion adhesive agent was then applied, over which silicon treated paper was applied, thereby obtaining a sheet of thermal printing medium in accordance with the present invention.

EXAMPLE 2

Over a corona electrical discharge processed 75 μm thick polyolefin type cross-laminate film (KM Film 750 W; Sunrex manufacturing, Inc.) as the support substrate, styrene butadiene latex (Tg 0° C.) with a solid component concentration of 50% was applied so as to form an under layer with a thickness such that the dry weight thereof was 4 g/m$^2$. Other than the addition of this under layer, the present example was carried out in a manner identical to Example 1.

EXAMPLE 3

Over the polyolefin type cross-laminate film employed in Example 2 above, styrene - methyl methacrylate - 2-methylhexyl methacrylate copolymer emulsion (Tg 30° C.) was applied so as to form an under layer with a thickness such that the dry weight thereof was 4 g/m$^2$. From the support substrate with the overlying under layer thus formed, a sheet of thermal printing medium in accordance with the present invention was prepared using means and materials identical to that of Example 2, aside from the composition of the under layer as described above.

EXAMPLE 4

Over the polyolefin type cross-laminate film employed in Example 2 above, a mixture consisting of 100 parts of an emulsion containing 40 weight % of styrene - acrylate ester copolymer (Tg 15° C.) and 50 parts of an aqueous dispersion containing 30 weight % of titanium oxide was applied so as to form an under layer with a thickness such that the dry weight thereof was 6 g/m$^2$. From the support substrate with the overlying under layer thus formed, a sheet of thermal printing medium in accordance with the present invention was prepared using means and materials identical to that of Example 2, aside from the composition of the under layer as described above.

COMPARATIVE EXAMPLE 1

For Comparative Example 1, a sheet of thermal printing medium was prepared identical to that of Example 1 of the present invention, except that the support substrate was replaced with 150 μm thick high grade paper.

COMPARATIVE EXAMPLE 2

For Comparative Example 2, a sheet of thermal printing medium was prepared identical to that of Example 2 of the present invention, except that the support substrate was replaced with 100 μm thick milk white polyethylene terephthalate film.

COMPARATIVE EXAMPLE 3

For Comparative Example 3, a sheet of thermal printing medium was prepared by applying an under layer, thermal developing layer and protective layer identical to that of Example 2 of the present invention to a 50 μm paper support substrate, over which 100 μm thick milk white polyethylene terephthalate film was applied, and to the rear surface of which, a polyacrylate ester type emulsion adhesive agent was then applied, over which silicon treated paper was applied.

RESULTS

Using a thermal printer (Matsushita Electric, Inc.), thermal printing at an electrical printing power of 0.5 W/dot and pulse width of 1.0 msec was carried out using each of the example sheets of thermal printing medium of the present invention and comparative example sheets of thermal printing medium prepared as described above. Printing density was then evaluated using a MacBeth RD-914 reflective densitometer. Additionally, using tags fabricated from the thermal printing media prepared in the above examples and comparative examples, bar codes were printed on each tag thus prepared using an Attison Avery bar code printer, and the resulting bar codes were visually inspected to assess the quality and resolution thereof.

Prior to applying the peelable backing, resistance to tearing forces along the length as well as to tearing forces along the width of the tags was tested according to Japanese Industrial Standard P-8116 using an Elmendorf tearing tester. The results obtained thereby were evaluated using mechanical strength assessment methods.

The results of the above described assessments are shown in Table 1 below:

TABLE 1

| | Printing Density | Bar Code Resolution | Tearing Strength (g/16 sheets) lengthwise | widthwise |
|---|---|---|---|---|
| Example 1 | 1.26 | good | 1470 | 932 |
| Example 2 | 1.35 | excellent | 1488 | 942 |
| Example 3 | 1.33 | excellent | 1390 | 903 |
| Example 4 | 1.35 | excellent | 1406 | 928 |
| Comparative Example 1 | 1.20 | poor | 94 | 103 |
| Comparative Example 2 | 1.25 | inferior | 120 | 116 |
| Comparative Example 3 | 1.20 | poor | 130 | 118 |

As is clear from Table 1 above, the thermal printing medium of the present invention, and accordingly, label and tags manufactured therefrom exhibit superior resistance to tearing and improved thermal printing resolution and printing density.

What is claimed is:

1. A thermal printing medium comprising:

a) a support substrate comprised of polyolefin cross-laminate film and having an upper and a lower surface; said cross-laminate film being characterized by at least two sheets of polyolefin having polyolefin adhesive therebetween, and being further characterized by said of said sheets having a linear, parallel aligned macromolecular orientation, the orientation of the macromolecules in one sheet forming an angle relative to the orientation of the macromolecules in a second sheet in the cross-laminated film;

b) a thermal developing layer formed on said upper surface of said support substrate, said thermal developing layer including at least one of a colorless and a lightly colored leuco dye, and a color developer agent as principle components thereof; and c) a protective layer formed on said upper surface of said thermal developing layer.

2. A thermal printing medium comprising:

a) a support substrate comprised of polyolefin cross-laminate film and having an upper and a lower surface; said cross-laminate film being characterized by at least two sheets of polyolefin having polyolefin adhesive therebetween, and being further characterized by said of each sheets having a linear, parallel aligned macromolecular orientation, the orientation of the macromolecules in one sheet forming an angle relative to the orientation of the macromolecules in a second sheet in the cross-laminated film;

b) an under layer formed on said upper surface of said support substrate, said under layer including a hydrophobic polymer as a principle component thereof;

c) a thermal developing layer formed on said upper surface of said under layer, said thermal developing layer including at least one of a colorless and a lightly colored leuco dye, and a color developer agent as principle components thereof; and d) a protective layer formed on said upper surface of said thermal developing layer.

3. A thermal printing medium in accordance with claim 2 above, wherein said hydrophobic polymer has a glass transition temperature (Tg) of no greater than 50° C.

4. A thermal printing medium comprising:

a) a support substrate comprised of polyolefin cross-laminate film and having an upper and a lower surface; said cross-laminate film being characterized by at least two sheets of polyolefin having polyolefin adhesive therebetween, and being further characterized by each of said sheets having a linear, parallel aligned macromolecular orientation, the orientation of the macromolecules in one sheet forming an angle relative to the orientation of the macromolecules in a second sheet in the cross-laminated film;

b) a thermal developing layer formed on said upper surface of said support substrate, said thermal developing layer including at least one of a colorless and a lightly colored leuco dye, and a color developer agent as principle components thereof;

c) a protective layer formed on said upper surface of said thermal developing layer; and d) a peelable sheet affixed to said lower surface of said support substrate via an adhesive layer between said peelable sheet and said lower surface of said support substrate.

5. A thermal printing medium comprising:

a) a support substrate comprised of polyolefin cross-laminate film and having an upper and a lower surface; said cross-laminate film being characterized by at least two sheets of polyolefin having polyolefin adhesive therebetween, and being further characterized by each of said sheets having a linear, parallel aligned macromolecular orientation, the orientation of the macromolecules in one sheet forming an angle relative to the orientation of the macromolecules in a second sheet in the cross-laminated film;

b) an under layer formed on said upper surface of said support substrate, said under layer including a hydrophobic polymer as a principle component thereof;

c) a thermal developing layer formed on an upper surface of said under layer, said thermal developing layer including at least one of a colorless and a lightly colored leuco dye, and a color developer agent as principle components thereof;

d) a protective layer formed on said upper surface of said thermal developing layer; and e) a peelable sheet affixed to said lower surface of said support substrate via an adhesive layer between said peelable sheet and said lower surface of said support substrate.

6. A thermal printing medium in accordance with claim 5 above, wherein said hydrophobic polymer has a glass transition temperature (Tg) of no greater than 50° C.

7. The thermal printing medium of claims 1, 2, 4 or 5, wherein said angle is 90°.

8. A label or tag comprising:

a) a support substrate comprised of polyolefin cross-laminate film and having an upper and a lower surface; said cross-laminate film being characterized by at least two sheets of polyolefin having polyolefin adhesive therebetween, and being further characterized by each of said sheets having a linear, parallel aligned macromolecular orientation, the orientation of the macromolecules in one sheet forming an angle relative to the orientation of the macromolecules in a second sheet in the cross-laminated film;

b) a thermal developing layer formed on said upper surface of said support substrate, said thermal developing layer including at least one of a colorless and a lightly colored leuco dye, and a color developer agent as principle components thereof;

c) a protective layer formed on said upper surface of said thermal developing layer; and d) a peelable sheet affixed to said lower surface of said support substrate via an adhesive layer between said peelable sheet and said lower surface of said support substrate.

9. A label or tag comprising:

a) a support substrate comprised of polyolefin cross-laminate film and having an upper and a lower surface; said cross-laminate film being characterized by at least two sheets of polyolefin having polyolefin adhesive therebetween, and being further characterized by each of said sheets having a linear, parallel aligned macromolecular orientation, the orientation of the macromolecules in one sheet forming an angle relative to the orientation of the macromolecules in a second sheet in the cross-laminated film;

b) an under layer formed on said upper surface of said support substrate, said under layer including a hydrophobic polymer as a principle component thereof;

c) a thermal developing layer formed on an upper surface of said under layer, said thermal developing layer including at least one of a colorless and a lightly colored leuco dye, and a color developer agent as principle components thereof;

d) a protective layer formed on said upper surface of said thermal developing layer; and e) a peelable sheet affixed to said lower surface of said support substrate via an adhesive layer between said peelable sheet and said lower surface of said support substrate.

10. A label or tag in accordance with claim 9, wherein said hydrophobic polymer has a glass transition temperature (Tg) of no greater than 50° C.

11. The label or tag of claims 8 or 9, wherein said angle is 90°.

* * * * *

UNITED STATES PATENT AND TRADEMARK OFFICE

CERTIFICATE OF CORRECTION

PATENT NO. : 5,151,403

DATED : September 29, 1992

INVENTOR(S) : Akira Suzuki et al.

It is certified that error appears in the above-identified patent and that said Letters Patent is hereby corrected as shown below:

item [57]

Title Page, Abstract, Line 3 change "additional" to --addition--;

Front Page, Abstract, Line 6 change "reslution" to --resolution--;

Front Page, Abstract, Line 10 change "fin type" to --fin-type--.

Claim 1, Column 9, Line 27 change "said of said" to --each of said--.

Claim 2, Column 9, Line 47 change "said of each" to

UNITED STATES PATENT AND TRADEMARK OFFICE

CERTIFICATE OF CORRECTION

PATENT NO. : 5,151,403

DATED : September 29, 1992

INVENTOR(S) : Akira Suzuki, et. al.

It is certified that error appears in the above-indentified patent and that said Letters Patent is hereby corrected as shown below:

--each of said--.

Signed and Sealed this

Twenty-first Day of December, 1993

*Attest:*

Bruce Lehman

BRUCE LEHMAN

*Attesting Officer*

*Commissioner of Patents and Trademarks*